United States Patent [19]

Sommars

[11] 4,037,575

[45] July 26, 1977

[54] ALTITUDE COMPENSATED FUEL CONTROL SYSTEM

[75] Inventor: Mark F. Sommars, Peoria, Ill.

[73] Assignee: Caterpillar Tractor Co., Peoria, Ill.

[21] Appl. No.: 607,322

[22] Filed: Aug. 25, 1975

[51] Int. Cl.[2] ..... F02D 1/04

[52] U.S. Cl. ..... 123/140 MC

[58] Field of Search ..... 123/140 MC

[56] References Cited

U.S. PATENT DOCUMENTS

| | | | |
|---|---|---|---|
| 2,988,881 | 6/1961 | Reggio | 123/140 MC |
| 3,077,873 | 2/1963 | Parks | 123/140 MC |
| 3,107,483 | 10/1963 | Hamilton | 123/140 MC |
| 3,313,283 | 4/1967 | Miller | 123/140 MC |
| 3,814,072 | 6/1974 | Gillespie | 123/140 MC |
| 3,924,594 | 12/1975 | Aoki | 123/140 MC |

*Primary Examiner*—Robert G. Nilson

*Attorney, Agent, or Firm*—John W. Grant

[57] ABSTRACT

An altitude compensated fuel control system includes a fuel control member for controlling flow of fuel to an internal combustion engine, a stop for limiting movement of the fuel control member toward an increased fuel direction establishing a maximum fuel flow position of the fuel control member and a device responsive to changes in atmospheric pressure for adjusting the maximum fuel flow position of the fuel control member with changes in atmospheric pressure so that the amount of fuel delivered to the engine decreases with an increase in altitude for maintaining a substantially constant air-fuel ratio.

6 Claims, 3 Drawing Figures

10
13
14
73
76
72
74
III
III
84
77
86
18
64
62
11
16
57
53
71
59
61
56
II
66
21
69
II
17
22
58
52
51
42
67
39
19
54
31
24
29
30
23
49
26
43
36
32
27
28
33
44
30
31
47
46
38
37
41
48
34
63

ALTITUDE COMPENSATED FUEL CONTROL SYSTEM

BACKGROUND OF THE INVENTION

This invention relates to a fuel control system for controlling the fuel flow of a compression ignition engine and more particularly to an altitude compensated device for adjusting the maximum fuel flow delivery to the engine with changes in altitude.

Compression ignition engines commonly utilize fuel injection systems for delivering fuel to the combustion chambers. With such fuel injection systems, a metered amount of fuel is delivered to the combustion chambers in accordance with the setting of a fuel pump feed rack which is normally controlled by a governor. A fixed full load rack stop is normally provided to limit the maximum volume of fuel directed to the engine for establishing the full load speed of the engine. One of the problems frequently encountered with such fuel systems is that the rack stop is normally set for a predetermined altitude range so that all fuel delivered to the combustion chambers is efficiently and completely burned. However, trucks having compression ignition engines frequently operate in both high altitude mountainous areas and low altitude plain areas. When the maximum fuel deivery is adjusted for low altitude conditions, excessive smoke is produced at the higher altitudes due to difference in air-fuel ratios. Conversely, when the maximum fuel delivery is adjusted for high altitude conditions the engine does not develop its maximum horse power capability at the lower altitudes.

OBJECTS OF THE INVENTION

Accordingly, an object of this invention is to provide an improved altitude compensated fuel control system which minimizes the amount of noxious exhaust emissions and smoke from the engine during altitude changes.

Another object of this invention is to provide such an improved altitude compensated fuel control system which reduces the maximum fuel delivery to the engine with increases in altitude to decrease the amount of noxious exhaust emissions from the engine at higher altitudes.

Another object of this invention is to provide an improved altitude compensated fuel control system which is altitude compensated automatically to adjust the maximum fuel flow delivered to the engine in accordance with the altitude at which the engine is operating.

Another object of this invention is to provide an improved altitude compensated device which may be employed on both naturally aspirated and turbocharged engines.

Other objects and advantages of the present invention will become more readily apparent upon reference to the accompanying drawings and following description.

DESCRIPTION OF THE PREFERRED EMBODIMENT

Figure 1:
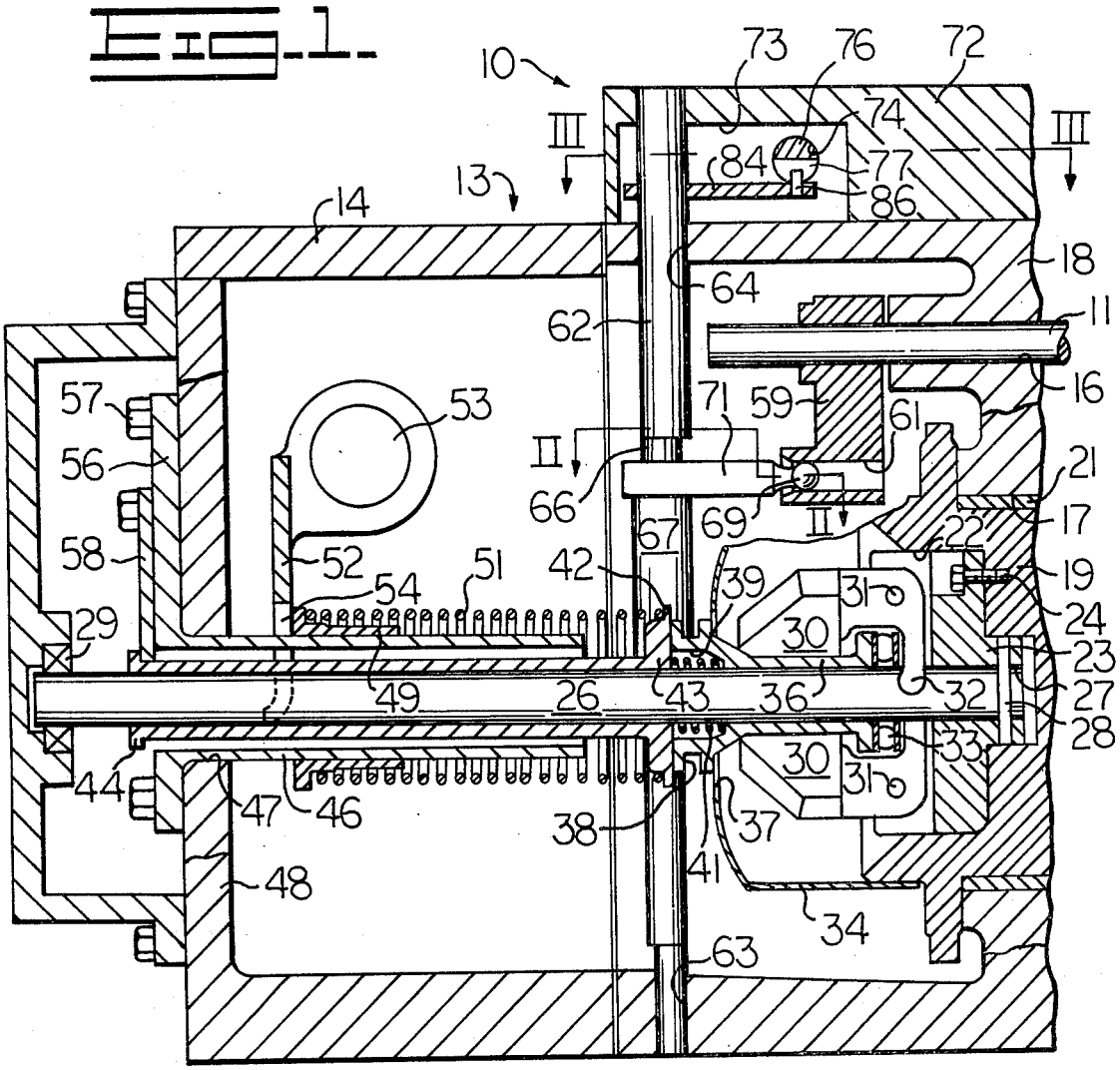
FIG. 1 is a longitudinal, vertical sectional view through a altitude compensated fuel control system embodying the principles of the present invention.
Figure 3:
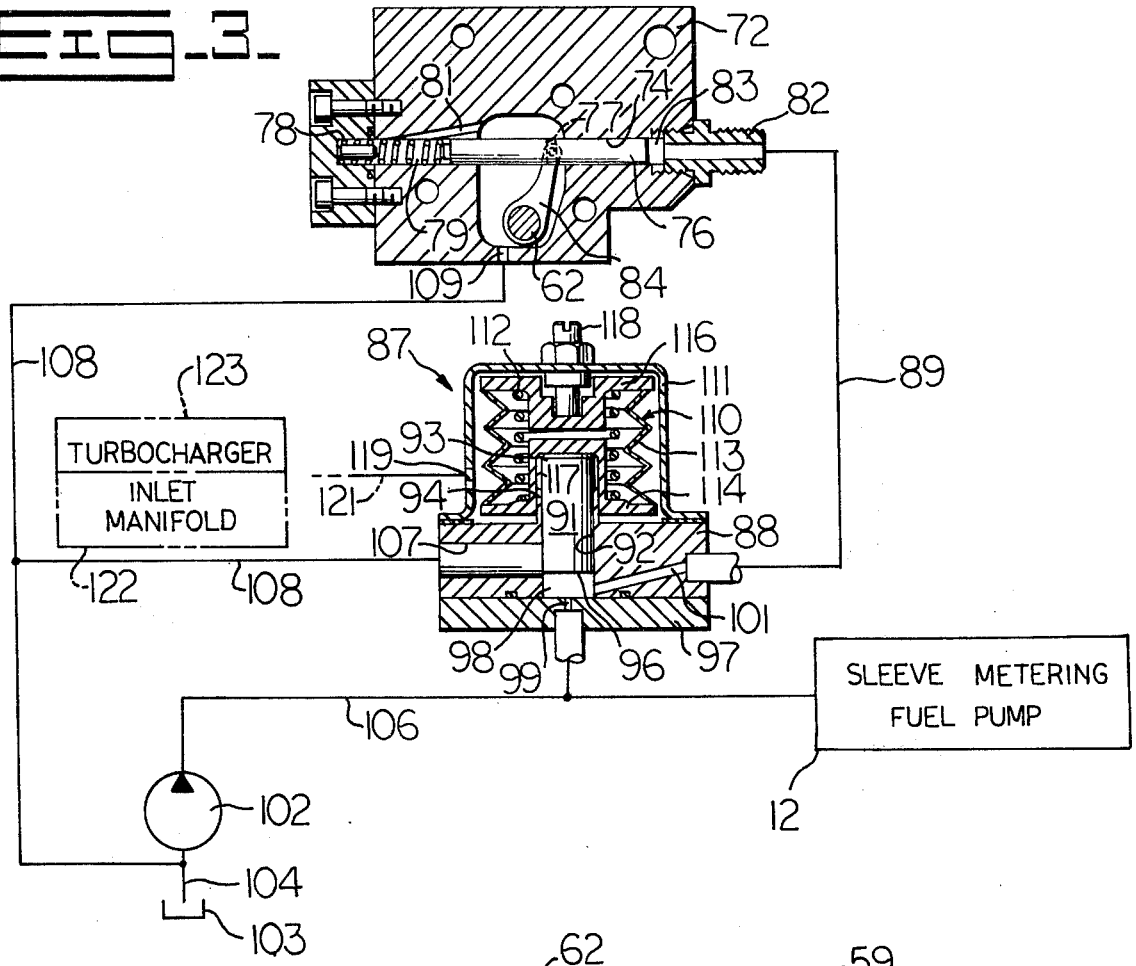
FIG. 3 is a sectional view taken along line III—III of FIG. 1 and including an altitude compensated fluid circuit.

Referring more particularly to the drawings, an altitude compensated fuel control system embodying the principles of the present invention is generally indicated by the reference numeral 10 for controlling the rotational position of a fuel control member partially shown at 11. The fuel control member is part of a sleeve metering pump shcematically illustrated at 12 in FIG. 3 and rotation of the fuel control member in a first direction increases fuel flow to the engine while rotation of the fuel control member in the opposite direction decreases fuel flow to the engine.

The altitude compensated fuel control system 10 includes a governor 13 which is contained within a housing 14 having a pair of bores 16 and 17 extending through an end wall 18. A cam shaft partially shown at 19 of the fuel pump 12 rotationally extends through a bearing 21 disposed within the bore 17 and has a stepped bore 22 formed therein. A flyweight carrier 23 is disposed within the stepped bore of the cam shaft and is secured thereto by a plurality of bolts, one shown at 24. An elongated governor drive shaft 26 extends into a bore 27 formed in the flyweight carrier and is secured thereto by a pin 28. The distal end of the drive shaft is rotatably supported by a bearing 29. A plurality of flyweights 30 are pivotally attached to the flyweight carrier by pins 31 with each flyweight having an inwardly extending arm 32 adapted to contact a thrust bearing 33 slidably disposed on the drive shaft. A cover 34 is secured to the cam shaft and encloses the flyweights.

A thrust collar 36 is slidably disposed on the drive shaft 26 and has one end in abutting engagement with the thrust bearing 33. The opposite end of the thrust collar extends through a bore 37 in the cover 34 and has an annular groove 38 formed on its periphery and an annular recess 39 formed therein in circumscribing relation to the drive shaft. An overfueling spring 41 is disposed within the recess and provides a resilient separating force between the thrust collar and a governor spring seat flange 42 of an elongated tubular member 43 slidably disposed on the drive shaft. A radially outwardly extending lip 44 is formed on the opposite end of the tubular member.

A tubular support 46 extends through a bore 47 in an end wall 48 of the housing 14 and into the housing in circumscribing relation to the tubular member 43. An annular governor spring seat 49 is slidably disposed on the tubular support. A governor spring 51 is disposed between the governor spring seat and the flange 42 for resiliently urging the tubular member 43 and the thrust collar 36 toward the flyweight carrier 23. A control lever 52 is attached to a control shaft 53 extending into the housing and has a bifurcated end 54 in engagement with the governor spring seat.

The tubular support has a flange 56 secured to the outside of the end wall by a plurality of bolts 57. A stop 58 is secured to the flange and is adapted for engagement with the annular lip 44 of the tubular member 43. The stop may be in the form of a torque spring for resiliently restraining movement of the tubular member to the right.

Figure 2:
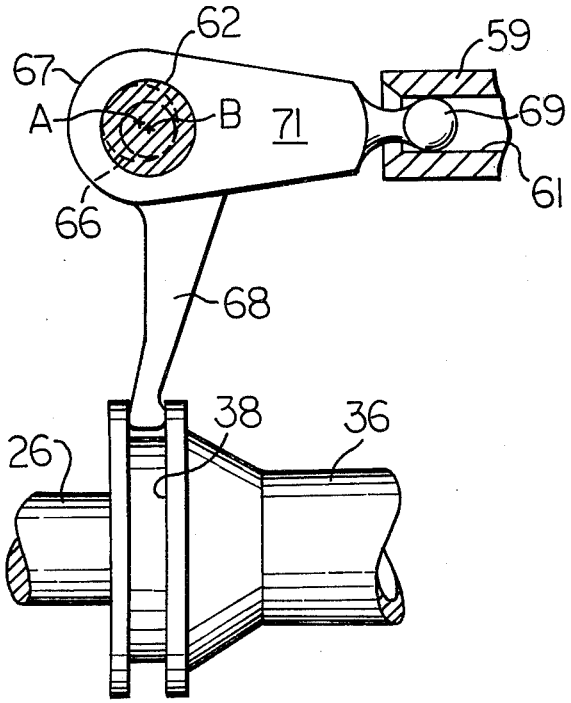
FIG. 2 is a somewhat enlarged fragmentary sectional view taken along line II—II on FIG. 1.

A lever 59 is secured to the fuel control member 11 extending through the bore 16 into the housing 14 and has a bore 61 formed in its distal end parallel to the fuel control member. An elongated pivot shaft 62 extends through the housing perpendicular to the drive shaft 26 with its lower end pivoted within a bore 63 formed in the housing while its upper end protrudes through a bore 64. As more clearly shown in FIG. 2, an intermediate section 66 of the shaft has its axis A radially offset from the axis B of the shaft, forming an eccentric for a later defined purpose. A bell crank 67 is pivoted on the intermediate portion. The distal end of a first arm 68 of the bell crank extends into the annular groove 38 of the thrust collar 36. A spherical end 69 is formed on the distal end of a second lever arm 71 with the spherical portion being disposed within the bore of the lever 59.

A body 72 is secured to the housing 14 and has a pocket 73 formed therein adjacent to the housing with the upper end of the shaft 62 extending into the pocket. As more clearly shown in FIG. 3, a horizontal bore 74 is formed in the body and slidably receives an elongated piston 76 which spans the pocket. A transversely disposed slot 77 is formed in the median portion of the piston. A spring 78 is disposed within a spring chamber 79 formed in the bore at one end of the piston with the spring chamber communicating with the pocket through a drain passage 81. A conduit fitting 82 is screwthreaded into the bore forming a fluid chamber 83 in the bore at the opposite end of the piston.

A lever 84 is secured to the end portion of the shaft 62 extending through the pocket 73. A pin 86 is secured to the distal end of the lever and extends vertically into the slot 77 of the piston 76.

A variable pressure relief valve 87, sensitive to changes in air pressure, is contained within a composite body 88 which is connected to the fluid chamber 83 through the fitting 82 and a conduit 89. The relief valve includes a valve spool 91 slidably disposed within a bore 92 in the valve body. An upper end 93 of the spool protrudes outwardly through an annular projection 94 of the body while a lower end 96 is spaced from a plate 97 secured to the lower side of the body forming a chamber 98. An orifice 99 is formed in the plate and communicates with the chamber while a passage 101 formed in the body communicates the chamber with the conduit 89. A transfer fuel pump 102 draws fluid from a tank 103 through an intake conduit 104 and is connected to the orifice and the sleeve metering fuel pump 12 through a conduit 106. A bleed port 107 formed in the body connects the bore 92 with a conduit 108 connected to the intake conduit. The conduit 108 also communicates with the pocket 73 of the body 72 through a port 109 formed in the body.

An aneroid bellows 110 is disposed within a cover 111 secured to the upper side of the body 88 and includes a spring 112 concentrically disposed within a bellows 113 which extends beween and is hermetically sealed to a pair of annular seats 114 and 116. The lower annular seat 114 has a recess 117 formed therein and which is slidably disposed on the upwardly extending annular projection 94 of the body. The lower annular seat rests on the upper end 93 of the piston. An adjusting screw 118 extends through the cover and is seated against the upper annular seat 116 for adjusting the preload on the aneroid bellows. A port 119 is provided in the cover to subject the aneroid bellows to atmospheric pressure when employed on a naturally aspirated engine.

The altitude compensated fuel control system is also adaptable for use on a turbocharged engine in which case, a conduit illustrated by broken lines at 121, connects the port 119 with an inlet manifold 122 which receives pressurized air from a turbocharger 123.

OPERATION

While the operation of the present invention is believed clearly apparent from the foregoing description, further amplification will subsequently be made in the following brief summary of such operation. The amount of fuel delivered to the engine, and thus the engine speed, is controlled by the rotational position of the fuel control member 11. The rotational position of the fuel control member is is turn controlled by the position of the thrust collar 36 through the bell crank 67, pivot shaft 62 and lever 59. Counterclockwise rotation of the bell crank increases the fuel flow to the engine while clockwise rotation of the bell crank causes a decrease of fuel flow to the engine.

The governor 13 functions to maintain the engine speed within a predetermined operating range by adjusting the rotational position of the bell crank 67 through the thrust collar 36 as the load of the enging varies. The predetermined speed range is established by manual positioning of the control lever 52 to provide a preload force on the governor spring 51 to act against the centrifugal force of the flyweights 30. When the load on the engine is increased, engine speed tends to decrease resulting in a corresponding reduction in the axial force of the flyweights, thereby allowing the governor spring to move the thrust collar to the right. This rotates the bell crank counterclockwise for supplying more fuel to the engine to maintain the engine speed within the desired range. As the tubular member and thrust collar are moved to the right under increasing engine loads, the lip 44 of the tubular member engages the stop 58 which limits the rotational movement of the fuel control member toward the increased fuel flow direction establishing a maximum fuel flow position of the fuel control member.

The transfer pump 102 is driven by the engine and directs fuel through the conduit 106 to the sleeve metering fuel pump 12 when the engine is running with the pump maintaining the fuel in the conduit at a predetermined pressure. A small portion of the fuel from the conduit is communicated into the chamber 98 through the orifice 99 which creates a pressure drop so that the fluid pressure in the chamber is lower than the fluid pressure in the conduit. The pressurized fluid in the chamber is communicated through the passage 101 and conduit 89 to the fluid chamber 83 in the body 72 where it exerts a force against the piston 76. The force of the pressurized fluid against the piston is counterbalanced by the force of the spring 78.

The fluid pressure in the chamber 98 and thus the chamber 83 is controlled by the valve spool 91 which meters fluid exhausted from the chamber 98 through the bleed port 107. The pressurized fluid in the chamber 98 urges the valve spool upwardly for establishing communication between the chamber and the bleed port with the upward force being counterbalanced by a force exerted by the aneroid bellows 110 tending to urge the valve spool downward for closing communication between the chamber and the bleed port. Thus, the force of the aneroid bellows establishes the fluid pressure in the chamber. However, when used with a naturally aspirated engine, the aneroid bellows is sensitive to changes in atmospheric pressure which occurs with altitude changes and the force exerted thereby increases with an increase in altitude. This causes an increase in the fluid pressure in the chamber as the altitude increases with such pressure increase being transmitted to the chamber 83.

When the altitude compensated device is used on a turbocharged engine, the aneroid bellows 110 is subjected to the boost pressure in the inlet manifold 122. However, the boost pressure in the inlet manifold decreases with an increase in altitude so that the force exerted by the aneroid bellows against the valve spool 91 increases as the altitude increases.

With the engine operating, the fluid pressure in the chamber 83 as established by the aneroid bellows 110 exerts a force against the piston 76 urging it leftwardly against the bias of the spring 78. At sea level, the counterbalancing forces of the spring and the fluid pressure against the piston causes the piston, lever 84 and the pivot shaft 62 to be positioned substantially as shown in the drawings. In such position, the fuel control member 11 is permitted to be rotated to its maximum fuel delivery position as determined by the contact between the lip 44 of the tubular member 43 and the stop 58.

When the engine is operating at a higher altitude the fluid pressure in the chambers 98 and 83 is higher than when the engine is operating at sea level as described above, causing the piston 76 to be moved correspondingly to the left against the bias of the spring 78. This causes counterclockwise rotation of the lever 84 and the pivot shaft 62 about its axis B resulting in the intermediate portion 66 of the shaft and the bell crank 67 being moved toward the thrust collar 36 as viewed in FIG. 2. This causes counterclockwise rotation of the lever 59 and thus the fuel control member 11 with the net effect being a decrease in the maximum fuel flow to the engine when the lip 44 is against the stop 58. The decrease in maximum fuel flow to the engine with an increase in altitude maintains a substantially constant air-fuel ratio for more efficient and complete burning of the fuel.

In view of the foregoing, it is readily apparent that the structure of the present invention provides an improved altitude compensated fuel control system which minimizes the emission of noxious matter and smoke from an internal combustion engine when the engine is operated at a higher altitude. This is accomplished by the incorporation of an air pressure sensitive device within the fuel control system for automatically adjusting the maximum fuel flow to the engine in accordance with the altitude at which the engine is operting. Thus, at low altitudes, or high atmospheric pressure, the maximum fuel flow is delivered to the engine so that the maximum horse power capability of the engine is achieved while the maximum fuel flow delivered to the engine is decreased at higher altitudes for maintaining a substantially constant air-fuel ratio for efficient and complete burning of the fuel.

While the invention has been described and shown with particular reference to the preferred embodiment, it will be apparent that variations might be possible that would fall within the scope of the present invention which is not intended to be limited except as defined in the following claims.

What is claimed is:

1. An altitude compensated fuel control system for an internal combustion engine comprising;

a fuel control member for controlling flow of fuel to the engine;

first means for controlling the position of the fuel control member including a stop for limiting movement of the control member towards an increased fuel flow direction establishing a maximum fuel flow position of the fuel control member;

second means for adjusting the maximum fuel flow position of the fuel control member in direct response to changes in altitude and hence to changes in atmospheric pressure resulting from changes in altitude so that the maximum amount of fuel delivered to the engine decreases with an increase in altitude; and wherein the fuel flow is controlled by rotary motion of the fuel control member, said first means includes a lever attached to the fuel control member and having a distal end, a pivot shaft having an eccentric intermediate portion formed thereon, a bell crank pivotally mounted on said eccentric portion and having a first arm and a second arm with said first arm pivotally associated with said distal end of said lever, and a speed responsive governor operatively connected to the second arm for pivoting the bell crank about the eccentric portion so that the first arm imparts rotary motion to the lever and the fuel control member.

2. The altitude compensated fuel control system of claim 1 wherein said second means includes a fluid system having a source of pressurized fluid and an air pressure sensitive variable pressure relief valve for varying the fluid pressure of the fluid system in accordance with the altitude at which the engine is operating, and third means operatively connected to the first means and responsive to fluid pressure in the fluid system for adjusting the maximum fuel flow position of the fuel control member.

3. The altitude compensated fuel control system of claim 2 wherein said third means includes a body having a bore formed therein, a piston slidably disposed in said bore and operatively connected to said first means, a chamber formed at one end of the piston, a conduit communicating pressurized fluid from said relief valve to said chamber, and a spring disposed in the bore at the opposite end of the piston for counterbalancing the force of the pressurized fluid in the chamber.

4. An altitude compensated fuel control system for an internal combustion engine comprising;

a fuel control member for controlling flow of fuel to the engine;

first means for controlling the position of the fuel control member including a stop for limiting movement of the control member toward an increased fuel flow direction establishing a maximum fuel flow position of the fuel control member;

second means for adjusting the maximum fuel flow position of the fuel control member in response to changes in atmospheric pressure so that the maximum amount of fuel delivered to the engine decreases with an increase in altitude including a fluid system having a source of pressurized fluid and an air pressure sensitive variable pressure relief valve for varying the fluid pressure of the fluid system in accordance with the altitude at which the engine is operating, said relief valve including a bore, a valve slidably disposed in said bore, a fluid chamber formed at one end of said valve, a bleed port connected to said bore with communication between the bleed port and the fluid chamber controlled by said valve, an orifice communicating pressurized fluid from the source of the pressurized fluid into the fluid chamber with the fluid urging the valve in a direction for establishing communication between the chamber and the bleed port, and an aneroid bellows operatively associated with the valve for resiliently urging the valve in a direction for closing communication between the fluid chamber and the bleed port, said aneroid bellow being responsive to a decrease in air pressure for increasing the fluid pressure in the fluid chamber, and third means operatively connected to the first means and responsive to fluid pressure in the fluid system for adjusting the maximum fuel flow position of the fuel control member, said third means including a body having a bore formed therein, a piston slidably disposed in said bore and operatively connected to said first means, a chamber formed at one end of the piston, a conduit communicating pressurized fluid from the fluid chamber of said relief valve to said chamber, and a spring disposed in the bore at the opposite end of the piston for counterbalancing the force of the pressurized fluid in the chamber; and wherein the fuel flow is controlled by rotary motion of the fuel control member, said first means includes a lever attached to the fuel control member and having a distal end, a pivot shaft having an eccentric intermediate portion formed thereon, the bell crank pivotally mounted on said eccentric portion and having a first arm and a second arm with said first arm pivotally associated with said distal end of said lever, and a speed responsive governor operatively connected to the second arm for pivoting the bell crank about the eccentric portion so that the first arm imparts rotary motion to the lever and the fuel control member.

5. The altitude compensated fuel control system of claim 4 wherein said third means includes a lever secured to the pivot shaft and having a distal end connected to said piston so that movement of the piston in a direction against the force of the spring due to increased fluid pressure in the fluid system resulting from a decrease in air pressure rotates the lever and eccentric shaft causing the fuel control member to be rotated in a direction for decreasing fuel flow to the engine.

6. The altitude compensated fuel control system of claim 5 wherein said second means includes an inlet manifold, a turbocharger for pressurizing the air in the inlet manifold, and means for subjecting the air pressure of the inlet manifold to the aneroid bellows so that the air pressure sensitive variable pressure relief valve is responsive to changes in inlet manifold pressure.

* * * * *